US005561922A

United States Patent [19]

Lynch

[11] Patent Number: 5,561,922

[45] Date of Patent: Oct. 8, 1996

[54] EXTRUSION DREDGING APPARATUS

[76] Inventor: Robert P. Lynch, 10177 S. 77th East Ave., Tulsa, Okla. 74133

[21] Appl. No.: 517,664

[22] Filed: Aug. 22, 1995

[51] Int. Cl.[6] ..... E02F 3/92

[52] U.S. Cl. ..... 37/317; 37/341

[58] Field of Search ..... 37/315, 316, 317, 37/334, 340, 341, 342, 344; 405/74

[56] References Cited

U.S. PATENT DOCUMENTS

| | | | |
|---|---|---|---|
| 2,029,858 | 2/1936 | Couch | 37/343 |
| 3,748,760 | 7/1973 | Suhnell | 37/341 X |
| 4,574,501 | 3/1986 | Sloan | 37/317 |
| 4,631,844 | 12/1986 | Deal | 37/341 X |

OTHER PUBLICATIONS

Cable Arm Clamshell. 1994.

Proprietary clamshell dredge. Dow Environmental, Inc. p. 15, (No date).

*Primary Examiner*—Terry Lee Melius

*Assistant Examiner*—Robert Pezzuto

[57] ABSTRACT

A marine dredging device comprised of scoop buckets pivotally connected to a reciprocating mechanism that extrudes soil into a receiver chamber and thence to upwardly extending soil transport tubes. Powered helices in the transport tubes serve to propel soil upwards to a discharge chute. Deployable silt curtains serve to close off the aperture between the scoop buckets and prevent the escape of sediments.

22 Claims, 7 Drawing Sheets

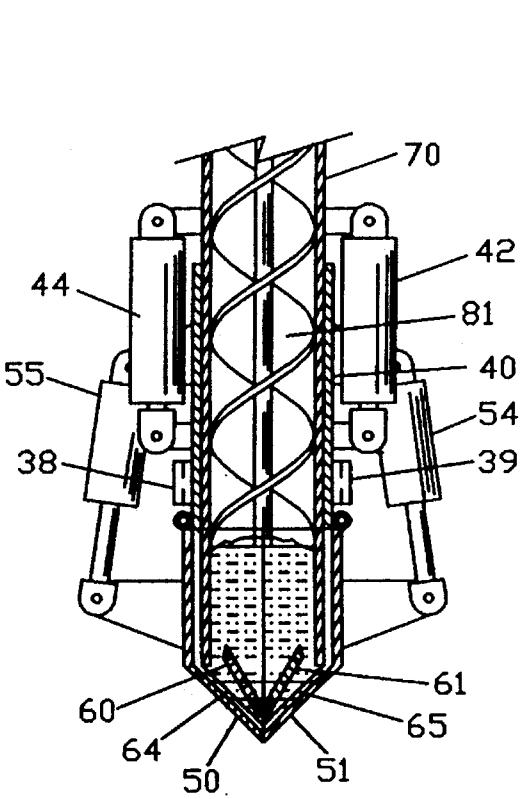
Fig 6-C
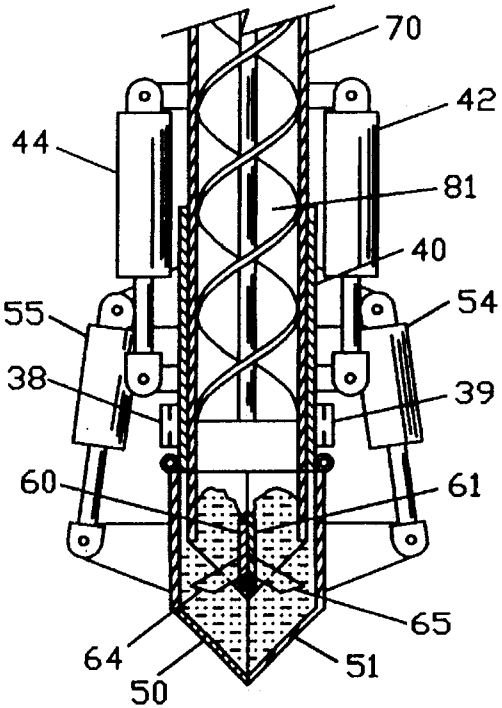
Fig. 6-B
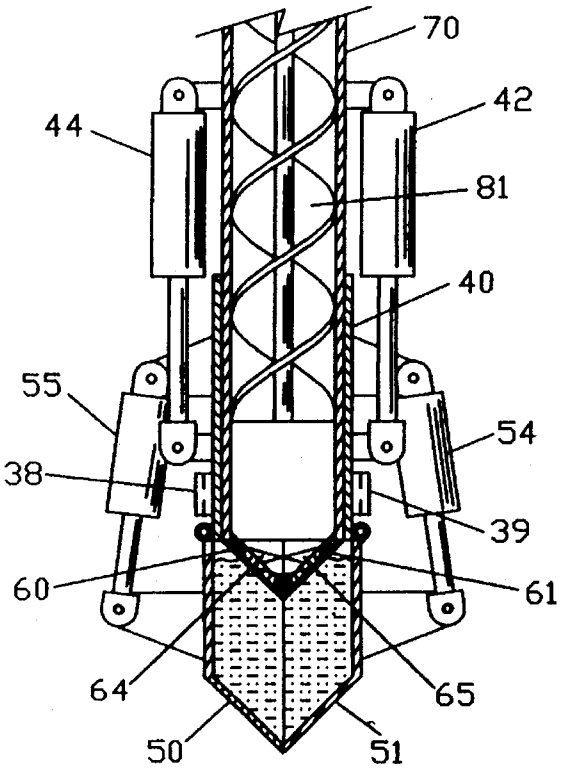
Fig. 6-A

EXTRUSION DREDGING APPARATUS

BACKGROUND OF THE INVENTION

1. Field of the Invention

This invention relates to the field of marine dredging.

2. Description of the Related Art

A search of the prior art did not reveal any marine dredging devices that employ the extrusion principle for the transport of dredged soil. However, as my invention is particularly suitable for dredging contaminated marine sediments, the following devices are discussed in this regard.

An apparatus identified by the trade name "Cable Arm Clamshell" is advertised as an environmental dredging device by Cable Arm Incorporated of Trenton, Mich. Their literature states that a patent is pending. This cable operated device differs from a conventional "grab bucket" type of dredge commonly known as a "clamshell bucket" in that it is less prone to spill excess soil due to the buckets forming a nominally closed compartment when the buckets are in the fully closed position.

My invention differs from the Cable Arm device in several aspects. The Cable Arm device must be retrieved from the water to discharge each "bite" of soil and therefore its use involves time wasted traveling through the water column and swinging to discharge the soil. Conversely, my apparatus, once deployed, does not have to be retrieved and is a more efficient continuous production system. My apparatus also incorporates deployable silt curtains which minimize the escape of disturbed soil during the closure of the scoop buckets. The Cable Arm device has no such feature.

A proprietary clamshell dredge is depicted in promotional literature provided by Dow Environmental Incorporated of Rockville, Md. This apparatus appears to be a conventional clamshell bucket with additional metal plating added to the sides and tops of the buckets to provide a nominally closed compartment when the buckets are in the fully closed position. The company's literature makes no claim of patents or patents pending.

My invention differs from the Dow Environmental device in several aspects. Again, my invention is a continuous production system while the Dow Environmental device must be retrieved from the water with each bite of soil. Furthermore, the Dow device does not incorporate deployable silt curtains.

A patent application pertaining to a CONTAMINATED MARINE SEDIMENTS DREDGING APPARATUS was submitted to the United States Commissioner of Patents and Trademarks by this inventor on Jul. 21, 1995. This apparatus must be retrieved from the water with each bite of soil. This invention differs from my previously submitted invention in that it is a continuous production system and thus offers a higher production efficiency.

BACKGROUND

The present invention relates to an apparatus and method for dredging marine sediments. This invention is also particularly suitable for dredging contaminated marine sediments.

In recent years society has come to acknowledge that contaminated marine sediments pose a hazard to marine life and ultimately to human life. Consequently, society has now determined that marine contaminants should be removed from the bodies of water where they lay.

Removal of contaminate marine sediments presents a problem that is not addressed by current dredging technology. It is crucial that the dredging process not spread the contamination to adjacent clean waters. Most water bodies have prevailing currents. If a dredging operation causes the suspension of fine soil particles that are contaminated, the current can transport these particles a considerable distance thus spreading the contamination over a broader area and further compounding the problem.

Historically, the primary objective of any dredging technique has been production efficiency. Stirring up the bottom of the water-body has been of little or no concern. Today, contaminated sediment dredging requires that particle suspension concerns take precedence over production maximization.

Water that has come in contact with dredged soil becomes contaminated. Some conventional dredging processes such as hydraulic dredging produce a large volume of associated water which is usually directed to a settling pond and returned to the water-body after the soil has settled. When the soil contains contaminated sediments, the associated water must be treated using a remediation process before it can be allowed back into the water-body. This requirement increases the degree of difficulty and cost of a project.

Conventional "grab bucket" dredging techniques such as "clamshell bucket" or "drag line bucket" are designed to operate without concern for excess soil spilling out of the bucket during operation. In order to maximize operating efficiency, these buckets normally over-filled which results in spilling during the water column excursion. These dredging techniques commonly produce a flume of waterborne sediments that is widely dispersed by the prevailing currents. Thus, the conventional grab bucket dredges are not well suited for the retrieval of contaminated marine sediments.

It can be appreciated that a preferred means of dredging contaminated marine sediments would be one that totally captures and contains all of the soil and sediments brought into the apparatus. A preferred process would also be one that minimized the volume of associated water taken with the soil. The invention described hereunder is a dredging device and method that accomplishes these objectives.

SUMMARY OF THE INVENTION

It is an object of this invention to provide a dredging apparatus that minimizes the suspension of contaminated marine sediments during operation of the system.

It is a further objective of this invention to describe a method of operating the apparatus that minimizes the suspension of contaminated marine sediments.

It is a further objective of this invention to provide a dredging apparatus that increases the production efficiency of grab bucket dredging.

It is a further objective of this invention to provide a dredging apparatus that increases the precision of grab bucket dredging.

It is a further objective of this invention to provide a dredging apparatus and process that produces a minimal volume of associated water.

In a broad sense this invention is a precision dredging apparatus that is exceptionally suitable for the retrieval of contaminated marine sediments. This invention has a relatively high production efficiency in comparison with conventional grab bucket dredges which makes it suitable for general dredging.

My invention is primarily comprised of a soil receiver chamber with non-return valves, scoop buckets, a sliding collar, vertical soil transport tubes with powered helices and deployable silt curtains.

The scoop buckets are pivotally connected to the sliding collar and are actuated by hydraulic linear actuators. When the scoop buckets are in the full open position, their cutting edges are nominally vertical to the plane of the soil. Thus, when the dredging apparatus is lowered into the soil, a minimum of penetration resistance is developed. Actuation of the hydraulic actuators causes the scoop buckets to close and capture a"bite" of soil.

The sliding collar surrounds the lower portion of the soil receiver chamber and translates vertically on same in a reciprocating manner. The actuation of the sliding collar is accomplished by hydraulic linear actuators interconnected between the chamber and collar. The scoop buckets, being pivotally connected to the sliding collar, also translate vertically.

A notable characteristic of this invention is the employment of the extrusion flow principle. When the sliding collar is retracted upwardly, the soil in the scoop buckets is extruded through the non-return valves which are located at the lower extremity of the soil receiver chamber. When subsequent bites of soil are extruded through the non-return valves, the previous bites are extruded up the vertical soil transport tubes and out of the discharge aperture.

It is significant to note that the lowermost extremity of the soil receiver is configured to match the shape of the scoop buckets. This design feature insures that the majority of the soil captured with each bite is extruded into the soil receiver chamber.

Another significant feature of this invention is the incorporation of a closing cam as an integral component of each non-return valve. The closing cams are designed to initiate partial closure of the non-return valves upon making contact with the inner surface of the scoop buckets as they near the end of their upward travel. This feature serves to mechanically insure that the non-return valves will close and not be held in the open position by the soil. It can be appreciated that, if the valves were not mechanically actuated, their non-return function could be negated by certain types of soil.

Another significant feature of this invention is the incorporation of powered helices located in the interior of the soil transport tubes. A helix used in this manner is commonly referred to as a "flight" in construction machinery terminology. Such flights have been used for the transportation of soil cuttings produced by horizontal and vertical earth boring machines. In this invention the flights are an option attachment for transporting soils that are not suitable for extrusion transport.

It can be appreciated that this invention may be used to dredge a variety of marine soils and sediments. Some soils will flow through the soil transport tubes in the extrusion mode. However, other soils may only be extrudable through a short distance and may tend to "bridge" or "jam" in the soil transport tubes. Thus it can be appreciated that the powered flight attachment allows this invention to be configured for a greater variety of marine soils and sediments.

It can be appreciated that during closure of the scoop buckets, disturbed soil would tend to be extruded out of the aperture between the bucket side plates. The objective of the silt curtain system is to close off this aperture and thus eliminate the possibility of disturbed soil flowing out of this opening.

The silt curtains translate vertically and are operated by hydraulic linear actuators which are interconnected to the sliding collar and the silt curtains. Prior to lowering the dredging apparatus into the soil, the silt curtains are positioned in their fully retracted position. They remain in this position until the dredging apparatus has been lowered to the full cut depth. Then the silt curtains are lowered by operating the hydraulic linear actuators. The silt curtains are differentially deployable and are mounted in guide bearings. The silt curtains also slide on the lateral surfaces of the sliding collar and scoop buckets and form a seal. The silt curtains are differentially deployed independent of each other so as to accommodate different soil depths on either side of the apparatus. This is a necessary feature because one side of the apparatus may be encountering virgin soil while the other is operating in loose soil or the void made by the previous cut. Thus the independent operation of the system allows each silt curtain to seat to the appropriate depth. Hydraulic accumulators are provided in the control circuitry so that the silt curtains may deploy to their full depth as the dredging apparatus is extracted from the soil thus sealing the seams of the buckets.

My invention can be employed using a "vessel of opportunity" such as a barge with a suitable handling system. The handling system can be a boom type crane or a modified hydraulic excavating machine commonly referred to as a "backhoe".

This invention is configured for each specific dredging project. The length of the soil transport tubes is adjusted for the project nominal water depth. Additional discharge chutes may be affixed to the apparatus to accommodate horizontal transport of the dredged soil from the discharge aperture to the intended container or barge. The powered flights are installed if the project soil is not amenable to extrusion transport.

The operation of my invention involves several distinct steps which are now discussed. When using a boom crane, the dredging apparatus is suspended from the load line and lowered to close proximity of the bottom. The scoop buckets are opened and the sliding collar actuated downward so as to cause the cutting edges to penetrate the soil to the required depth or the depth at which penetration resistance supercedes the system force capacity. The silt curtains are then deployed. The scoop buckets are then actuated to full closure. Next the sliding collar is retracted to its uppermost position. The powered flights are put into operation if they have been installed. The apparatus is then positioned for the next bite. The silt curtains are retracted and the scoop buckets are opened. The cycle is then repeated.

While the preferred embodiment and use of this dredging apparatus lies in dredging contaminated marine sediments, it may also be used for conventional dredging on non-contaminated soils. The extrusion mode of dredging results in the scoop buckets reciprocating vertically a minimal distance and thus offers great operating efficiencies in comparison to grab bucket dredges which must be removed from the water to discharge each bite of soil. The silt curtains also offer an increase in operating efficiency in that they prevent soil from escaping out of the sides of the buckets during closure thus resulting in a greater amount of soil retrieved per cycle.

It can be appreciated that this dredging apparatus offers an improved means of retrieving contaminated marine sediments that has obvious advantages over conventional dredging apparatus and techniques. It has the advantages of a high efficiency production rate coupled with a precise operating mode. Furthermore, it is environmentally sensitive in that it minimizes the possibility of spreading contaminants further and produces minimal quantities of associated water. Therefore, my dredging apparatus offers society an economical means heretofore unavailable for cleaning contaminated water-bodies without spreading the contamination.

The objectives are meant to be illustrative and are not limiting. The manner of operation, novel features and further objectives and advantages of my invention may be better understood by reference to the following description and drawings.

BRIEF DESCRIPTION OF THE DRAWINGS

FIG; 1 is a perspective view of the dredging apparatus with the scoop buckets open and the silt curtains retracted.

FIG. 6-A, B, and C are sectional views of the dredging apparatus showing the function of the non-return valves.

LIST OF REFERENCE NUMERALS

Figure 1:
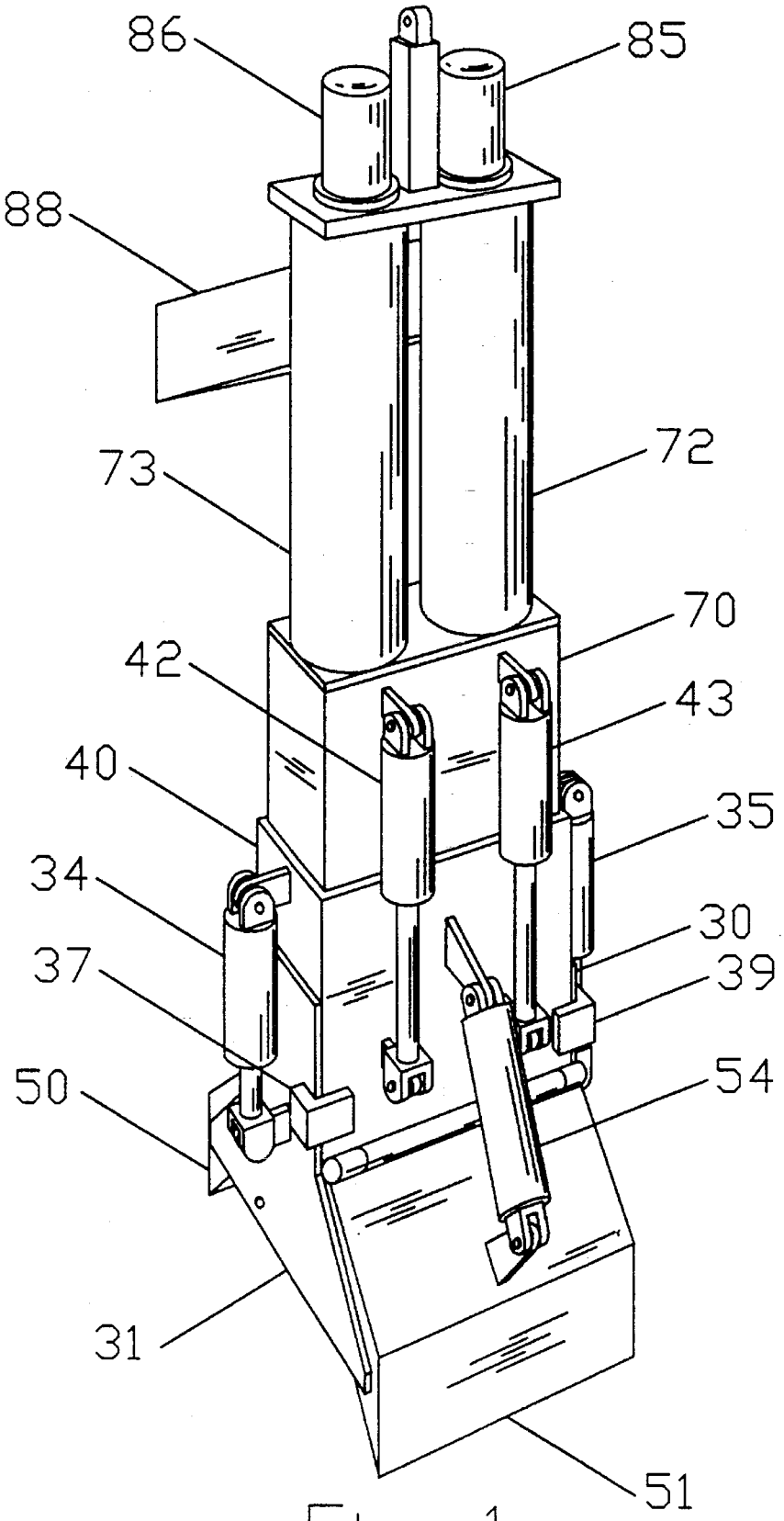

30 silt curtain
31 silt curtain
34 silt curtain hydraulic linear actuator
35 silt curtain hydraulic linear actuator
36 silt curtain guide bearing
37 silt curtain guide bearing
38 silt curtain guide bearing
39 silt curtain guide bearing
40 sliding collar
42 sliding collar hydraulic linear actuator
43 sliding collar hydraulic linear actuator
44 sliding collar hydraulic linear actuator
45 sliding collar hydraulic linear actuator
50 scoop bucket
51 scoop bucket
54 scoop bucket hydraulic linear actuator
55 scoop bucket hydraulic linear actuator
60 non-return valve
61 non-return valve
64 non-return valve cam
65 non-return valve cam
70 soil receiver chamber
72 soil transport tube
73 soil transport tube
80 flight
81 flight
85 flight hydraulic motor
86 flight hydraulic motor
88 discharge chute
90 hydraulic pump
91 hydraulic reservoir
95 solenoid operated valve
96 solenoid operated valve
97 solenoid operated valve
98 solenoid operated valve
99 solenoid operated valve
101 accumulator
102 accumulator
103 accumulator
104 hydraulic pressure gage
105 hydraulic pressure gage
106 hydraulic pressure gage
107 hydraulic pressure gage
108 hydraulic pressure gage
111 hydraulic hose
112 hydraulic hose
113 hydraulic hose
114 hydraulic hose
115 hydraulic hose
116 hydraulic hose
117 hydraulic hose
118 hydraulic hose
119 hydraulic hose
120 hydraulic hose

DETAILED DESCRIPTION OF THE PREFERRED EMBODIMENT

FIG. 1 illustrates the dredging apparatus in perspective view. As seen in FIG. 1, scoop buckets 50 and 51 are in the open position and silt curtains 30 and 31 are retracted.

Figure 2:
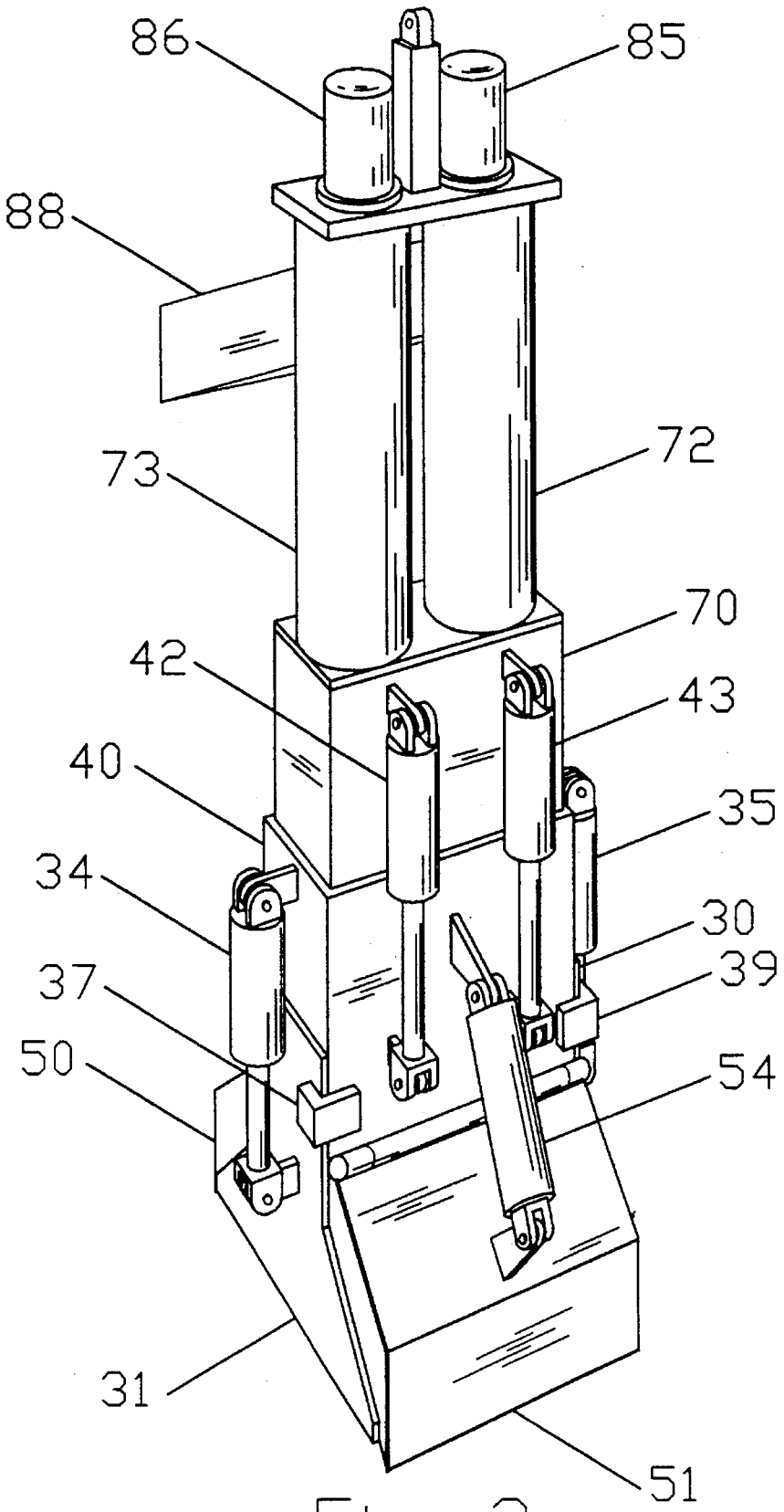
FIG. 2 is a perspective view of the dredging apparatus with the scoop buckets open and the silt curtains deployed.

FIG. 2 illustrates the dredging apparatus in perspective view. As seen in FIG. 2, scoop buckets 50 and 51 are in the open position and silt curtains 30 and 31 are in the deployed position.

Figure 3:
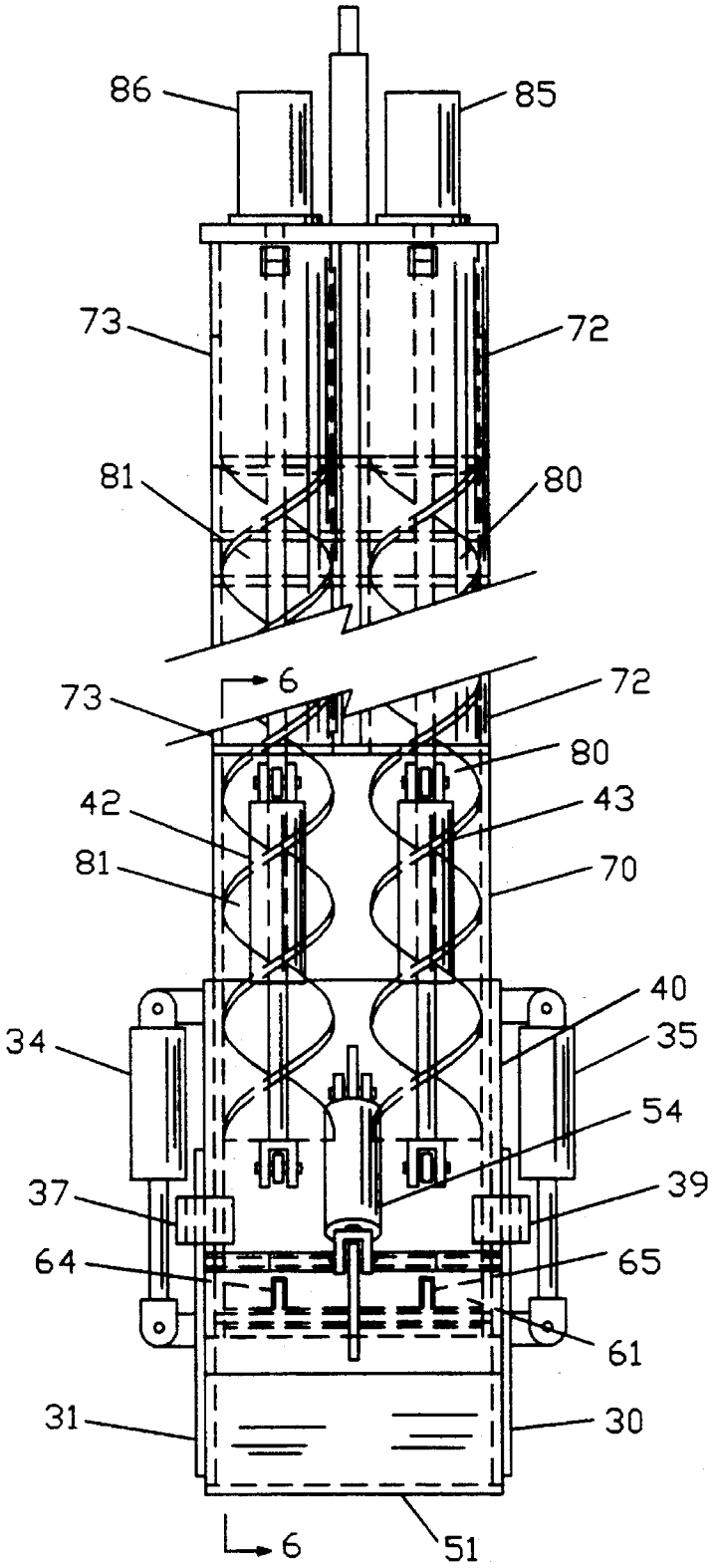
FIG. 3 is a side elevation of the dredging apparatus.

FIG. 3 is an elevation of the dredging apparatus with scoop buckets 50 and 51 in the open position and silt curtains, 30 and 31 in the deployed position.

Figure 4:
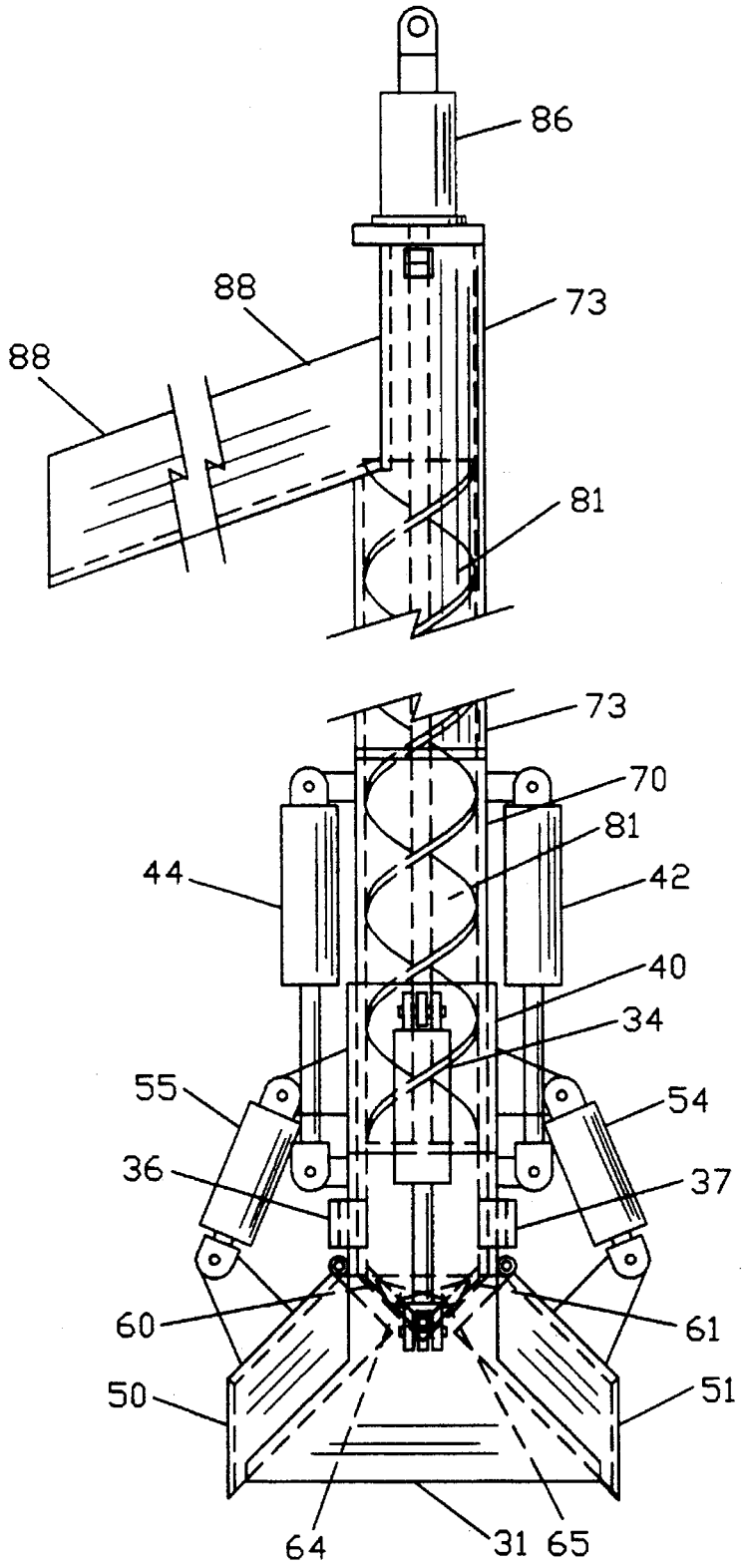
FIG. 4 is an end elevation of the dredging apparatus.

FIG. 4 is an end elevation of the dredging apparatus with scoop buckets 50 and 51 in the open position and the silt curtains 30 and 31 in the deployed position.

Figure 5:
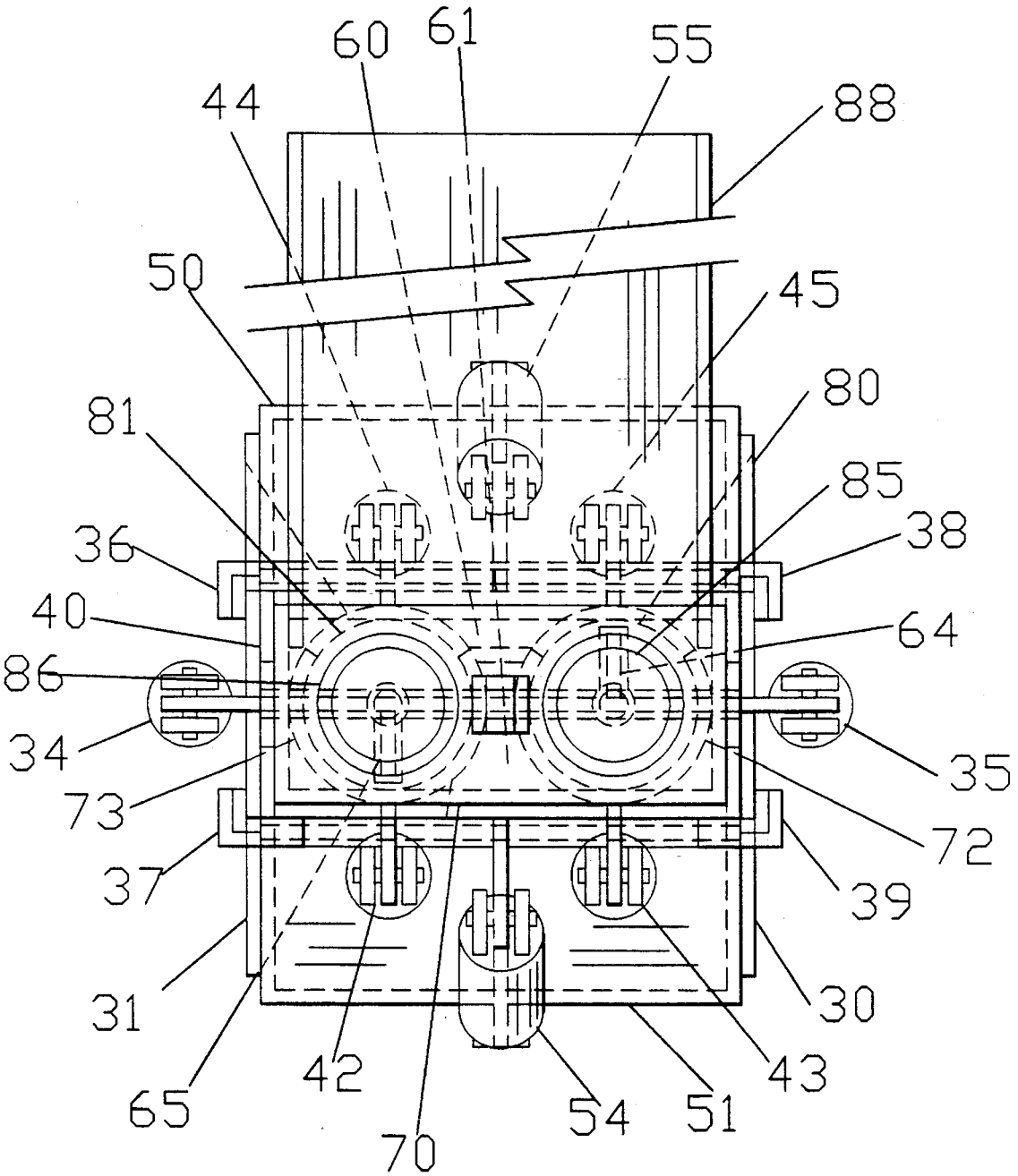
FIG. 5 is a plan view of the dredging apparatus.

FIG. 5 is a plan view of the dredging apparatus with scoop buckets 50 and 51 in the open position.

Referring now to FIG. 1 and FIG. 3. Sliding collar 40 is actuated in the vertical direction in relation to soil receiver chamber 70 by hydraulic linear actuators 42, 43, 44, and 45. In this embodiment four hydraulic linear actuators are incorporated and are interconnected to sliding collar 40 and soil receiver chamber 70. This apparatus may be constructed in various sizes. It can be appreciated that the vertical actuation of sliding collar 40 could be accomplished by more or less than four actuators and such an arrangement would also be within the spirit of this invention.

Referring now to FIG. 4, it can be seen that scoop buckets 50 and 51 are pivotally connected to the lower extremity of sliding collar 70. Hydraulic linear actuators 54 and 55 are interconnected between sliding collar 40 and scoop buckets 50 and 51. Actuation of these actuators causes scoop buckets 50 and 51 to rotate to the closed position.

Referring again to FIG. 3 and FIG. 4, it can be seen that soil transport tubes 72 and 73 are affixed to the upper extremity of soil receiver chamber 70. It can also be seen that the helix shaped flights 80 and 81 are mounted centrally within soil transport tubes 72 and 73. A portion of flights 80 and 81 extend downward into the soil receiver chamber 70. Hydraulic motors 85 and 86 are mounted on the upper extremity of soil transport tubes 72 and 73 and are shaft connected to helix shaped flights 80 and 81 and serve to power their operation. It can also be seen that discharge chute 88 is affixed to the material surrounding an opening in soil transport tubes 72 and 73.

FIG. 6-A, B, and C are sectional views of the dredging apparatus illustrating the function of non-return valves 60 and 61. It can be seen that non-return valves 60 and 61 are pivotally attached to the lower extremity of soil receiver 70. Non-return valve cams 64 and 65 are apparent in this view.

Cam 64 is affixed to non-return valve 61. Cam 65 is affixed to non-return valve 60.

In FIG. 6-A, scoop buckets 50 and 51 have been closed by hydraulic linear actuators 54 and 55 with a portion of soil captured within scoop buckets 50 and 51. In FIG. 6-B, sliding collar 40 has been partially retracted in the vertical direction causing the soil to flow through non-return valves 60 and 61. In FIG. 6-C, sliding collar 40 has been fully retracted and cams 64 and 65 have made contact with the inner surfaces of scoop buckets 50 and 51 which results in non-return valves 60 and 61 being pivoted to a partially closed position. It can be appreciated that when scoop buckets 50 and 51 are lowered or opened, the weight of the soil in soil receiver chamber 70 will cause full closure of non-return valves 60 and 61. It can be further appreciated that subsequent repetition of this cycle will cause the soil level in soil receiver chamber 70 to increase and reach the level of flights 80 and 81 and soil transport tubes 72 and 73 and thence be transported to discharge chute 88.

Referring again to FIG. 3. While this embodiment of the dredging apparatus incorporates two soil transport tubes 72 and 73 and two flights 80 and 81, it can be appreciated that the system could be made to function in a single tube and flight arrangement. Furthermore, the dredging apparatus could be configured with an arrangement of three or more flights and soil transport tubes. Such alternate arrangements do not depart from the spirit of this invention.

Referring now to FIG. 3, FIG. 4, and FIG. 5. Silt curtain guide bearings 36, 37, 38 and 39 can be seen affixed to sliding collar 40. Silt curtains 30 and 31 slide within these guide bearings and are actuated by hydraulic linear actuators 34 and 35 which are interconnected between sliding collar 40 and silt curtains 30 and 31. Guide bearings 36, 37, 38 and 39 also serve to hold silt curtains 30 and 31 tight against the lateral ends of scoop buckets 50 and 51 and against sliding collar 40 thus forming a soil seal. It can be appreciated that positioning silt curtains 30 and 31 in the lower extended position closes the aperture between scoop buckets 50 and 51 and thus prevents lateral extrusion of disturbed soil during bucket closure.

Referring now to FIG. 3. This dredging apparatus is intended for operations in a range of water depths. Thus, the length of soil transport tubes 72 and 73 are fabricated for each particular project water depth. The length of flights 80 and 81 are likewise fabricated to an appropriate length for the project water depth. It can be appreciated that short lengths of soil transport tubes with bolt flanges and sectional flights could be incorporated without departing from the spirit of this invention.

Figure 7:
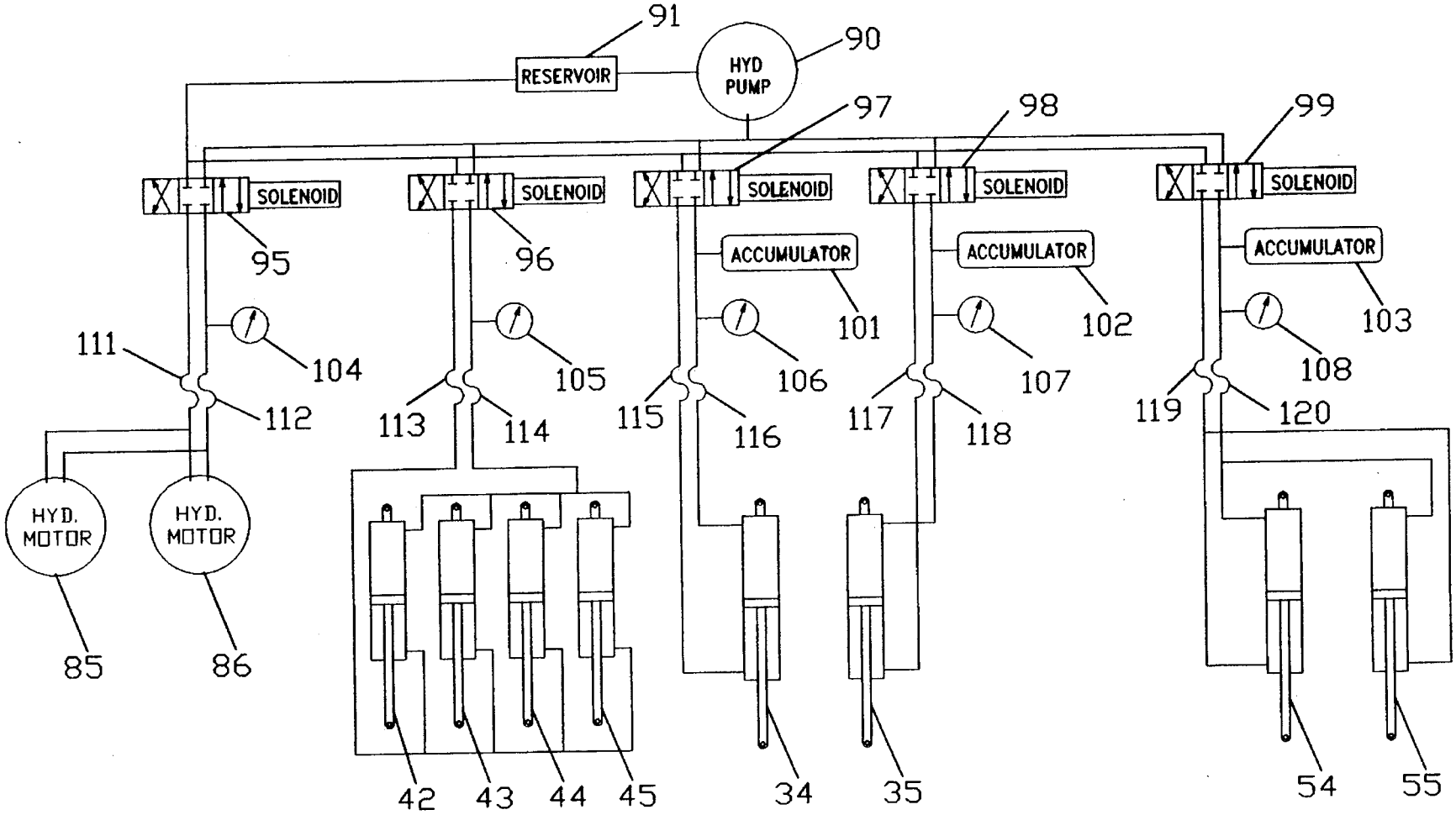
FIG. 7 is a schematic view of the control system.

FIG. 7 illustrates schematically the prime mover power sources and the system control operators. Hydraulic pump 90 generates hydraulic power that operates hydraulic linear actuators 34, 35, 42, 43, 44, 45, 54, 55, and hydraulic motors 85 and 86. Reservoir 91 provides source oil for the hydraulic system. The power generation and control functions are located above water. The actuation functions are normally operated below the water surface. Flexible hydraulic hoses 111, 112, 113, 114, 115, 116, 117, 118, 119, and 120 transmit hydraulic power to the underwater components.

Again referring to FIG. 7, solenoid valve 95 controls hydraulic motors 85 and 86 which power flights 80 and 81. Hydraulic pressure gage 104 is provided in the circuit to monitor the functioning of hydraulic motors 85 and 86.

Again referring to FIG. 7, solenoid valve 96 controls hydraulic linear actuators 42, 43, 44, and 45 which actuate the vertical translation of sliding collar 40. Hydraulic pressure gage 105 is provided in the circuit to monitor the functioning of hydraulic linear actuators 42, 43, 44, and 45.

Again referring to FIG. 7 and FIG. 5, solenoid valve 97 controls hydraulic linear actuator 34 which actuates the vertical translation of silt curtain 31. Accumulator 101 is provided to maintain pressure for further actuation of silt curtain 31 after solenoid valve 97 has been closed. Hydraulic pressure gage 106 is provided in the circuit to monitor the functioning of hydraulic linear actuator 34.

Again referring to FIG. 7 and FIG. 5, solenoid valve 98 controls hydraulic linear actuator 35 which actuates the vertical translation of silt curtain 30. Accumulator 102 is provided to maintain pressure for further actuation of silt curtain 30 after solenoid valve 98 has been closed. Hydraulic pressure gage 107 is provided in the circuit to monitor the functioning of hydraulic linear actuator 35.

Again referring to FIG. 7 and FIG. 5, solenoid valve 99 controls hydraulic linear actuators 54 and 55 which actuate scoop buckets 50 and 51. Accumulator 102 is provided to maintain pressure for further actuation of scoop buckets 50 and 51 after solenoid valve 99 has been closed. Hydraulic pressure gage 108 is provided in the circuit to monitor the functioning of hydraulic linear actuators 54 and 55.

OPERATION OF THE INVENTION

This apparatus can be utilized aboard a vessel of opportunity such as a barge with a handling device such as a crane or back-hoe. Attaching the dredging apparatus to a crane or back-hoe and using same to handle the apparatus is an ordinary engineering task and known art and thus will not be discussed herein. For the purpose of clarity and simplicity, a crane will be considered as the handling device in the following discussion.

Referring now to FIG. 3. This dredging apparatus is intended for operations in a range of water depths. Thus, the length of soil transport tubes 72 and 73 are fabricated to suit the project water depth. The length of flights 80 and 81 are likewise fabricated to an appropriate length for the project water depth.

Referring again to FIG. 1. The dredging apparatus is lowered by the crane to the immediate vicinity of the bottom with sliding collar 40 in the retracted position, scoop buckets 50 and 51 in the open position and silt curtains 30 and 31 in the retracted position.

Referring now to FIG. 1 and FIG. 7. Solenoid valve 95 is operated to operate hydraulic motors 85 and 86. Solenoid valve 96 is then operated to actuate hydraulic linear actuators 42, 43, 44, and 45 which lower sliding collar 40 and scoop buckets 50 and 51 into the bottom soil. Solenoid valves 97 and 98 are then operated to deploy silt curtains 34 and 35. Solenoid 99 is then operated to actuate hydraulic linear actuators 54 and 55 to close scoop buckets 50 and 51. Solenoid 96 is now reversed to actuate hydraulic linear actuators 42, 43, 44, and 45 in the reverse direction and retract sliding collar 40. Solenoids 97 and 98 are now reversed to actuate hydraulic linear actuators 34 and 35 in the reverse direction and retract silt curtains 30 and 31. Solenoid 99 is now reversed to actuate hydraulic linear actuators 54 and 55 in the reverse direction and open scoop buckets 50 and 51. The dredging apparatus is moved laterally to the next excavation position and the above cycle is then repeated.

CONCLUSION, RAMIFICATION AND SCOPE OF INVENTION

The reader can see that my invention is a new dredging apparatus that is a significant advancement over conventional grab-bucket dredging devices and procedures. Conventional grab-bucket dredges are characterized by intermittent production and lost time due to retrieval from the water. My invention improves the efficiency of grab-bucket dredging by eliminating the need to recover the apparatus from the water with each bite of soil. It therefore provides a grab-bucket dredging procedure that is a continuous production process.

The reader can also see that my invention is particularly well suited for the retrieval of contaminated marine sediments. Several features 5 of my dredging apparatus minimize the possibility of stirring up the bottom and spreading the contaminated sediments. My dredge is slowly thrust downward by hydraulic actuators into the soil to take each bite. Conventional grab-bucket dredges are dropped rapidly and depend on velocity and momentum to penetrate the bottom. This is a violent activity that results in stirring up and spreading contaminated sediments. Conventional grab-bucket dredges also spill sediments as they are raised through the water column which further disperses contamination while my invention eliminates this possibility. The deployable silt curtains of my invention prevent the escape of disturbed sediments during closure of the scoop buckets. Conventional grab-bucket dredges have no comparable feature.

Dredging with conventional grab-bucket dredges is an imprecise activity. While precision is not normally a requirement associated with conventional dredging projects, it is an important factor in contaminated sediments retrieval dredging. Because of the hazardous nature of contaminated sediments, their location and depth are carefully delineated. It is desirable that the retrieval process carefully follow the pre-determined boundaries of the contamination. While the scoop buckets of my dredging apparatus reciprocate vertically thorough a short distance, the main body of the apparatus remains at a nominally constant depth during dredging. This feature means that the depth of each bite can be precisely controlled.

My invention ingests a minimal volume of associated water when operating. Associated water becomes contaminated during dredging and must be treated which is an expensive process. My dredging apparatus reduces this cost by minimizing associated water.

There are important ramifications to my invention in that the Federal Government is soon to issue guidelines for the remediation of contaminated bodies of water. It is anticipated that most bodies of water that have an adjacent industrial site on the shore will require a remediation effort. Many marine locations have been identified that contain hazardous contaminants that must be contained during the removal process.

Maintenance dredging of harbors and waterways is an ongoing process. It is anticipated that, in most instances, the new Federal guidelines will result in a portion of the dredging being classified as contaminated sediments.

In conclusion, my invention offers a means of effectively and economically retrieving contaminated marine sediments in a manner that minimizes the possibility of further damage to the marine environment. In addition, there will be a growing need for my invention as society becomes aware that contaminated sediments can be safely dredged at reasonable cost and therefore should be retrieved.

While my invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claims including the full range of equivalency to which each element thereof is entitled.

What is claimed is:

1. A marine dredging device comprising:

a soil receiver chamber;

a sliding collar surrounding a portion of said soil receiver chamber;

scoop buckets pivotally connected to said sliding collar translatable silt curtains adjacent to lateral extremities of the scoop buckets serving to block an aperture between said scoop buckets;

one or more non-return valves located at the lower extremity of said soil receiver chamber;

actuation means to pivot said scoop buckets in relation to said sliding chamber;

actuation means to translate said sliding collar in relation to said soil receiver chamber;

one or more upwardly extending soil transport tubes with soil discharge apertures at or near the upper extremities of said tubes.

2. A marine dredging device as described in claim 1 with the inclusion of:

translatable silt curtains adjacent to the lateral extremities of said scoop buckets serving to block the aperture between said scoop buckets;

actuation means for translating said silt curtains relative to said scoop buckets.

3. A marine dredging device as described in claim 2 wherein the silt curtain actuation means is comprised of:

a hydraulic pressure source;

hydraulic linear actuators interconnected between said silt curtains and said sliding collar so as to impart translation motion of said silt curtains relative to said sliding collar;

means to control flow of hydraulic oil to said hydraulic linear actuators.

4. A marine dredging device as described in claim 2 wherein said translatable silt curtains may be operated independent of each other.

5. The method of operating the apparatus of claim 2 whereby:

the device is lowered to the bottom of a body of water with said scoop buckets in the open position and said silt curtains in the retracted position;

the device is thence lowered into the soil;

said silt curtains are thence lowered to make contact with said water bottom;

said scoop buckets are thence closed capturing a portion of soil;

said sliding collar is thence retracted thus extruding said soil into said soil receiver and said soil transport tubes;

said silt curtains are thence retracted;

said scoop buckets are thence opened;

said sliding collar is thence lowered thus driving said scoop buckets into said water bottom;

the above sequence of events is repeated in a cyclical fashion.

6. A marine dredging device as described in claim 1 wherein the actuation means is comprised of:

a hydraulic pressure source;

hydraulic linear actuators interconnected between said soil receiver chamber and said scoop buckets so as to impart pivoting motion of said scoop buckets relative to said soil receiver chamber;

hydraulic linear actuators interconnected between said sliding collar and said soil receiver chamber so as to impart translation motion of said sliding collar relative to said soil receiver chamber;

means to control flow of hydraulic oil to said hydraulic linear actuators.

7. A marine dredging device as described in claim 1 wherein:

when said scoop buckets are in the fully closed position;

the position, shape and orientation of said non-return valves corresponds with the lowermost inner surfaces of said scoop buckets;

the position, shape and orientation of said soil receiver chamber corresponds with the uppermost inner surfaces of said scoop buckets.

8. A marine dredging device as described in claim 1 with the inclusion of:

cam members affixed to said non-return valves configured to initiate closing of said valves upon contacting said scoop buckets.

9. The method of operating the apparatus of claim 1 whereby:

the device is lowered to the bottom of a body of water with the scoop buckets in the open position and the silt curtains in the retracted position;

the device is thence lowered into the soil;

said scoop buckets are thence closed capturing a portion of soil;

the sliding collar is thence retracted thus extruding said soil into the soil receiver and soil transport tubes;

said scoop buckets are thence opened;

said sliding collar is thence lowered thus driving said scoop buckets into said water bottom;

the above sequence of events is repeated in a cyclical fashion.

10. A marine dredging device comprising:

a soil receiver chamber;

a sliding collar surrounding a portion of said soil receiver chamber;

scoop buckets pivotally connected to said sliding collar; translatable silt curtains adjacent to lateral extremities of the scoop buckets serving to block an aperture between said scoop buckets, actuation means to pivot said scoop buckets in relation to said sliding collar;

actuation means to translate said sliding collar in relation to said soil receiver chamber;

one or more upwardly extending soil transport tubes with soil discharge apertures at the uppermost extremities of said tubes, helices located within said soil transport tubes with nominally coincident axes;

a rotary actuation means to effect rotation of said helices.

11. A marine dredging device as described in claim 10 with the inclusion of:

translatable silt curtains adjacent to the lateral extremities of said scoop buckets serving to block the aperture between said scoop buckets;

actuation means for translating said silt curtains relative to said scoop buckets.

12. A marine dredging device as described in claim 11 wherein the silt curtain actuation means is comprised of:

a hydraulic pressure source;

hydraulic linear actuators interconnected between said silt curtains and said sliding collar so as to impart translation motion of said silt curtains relative to said sliding collar;

means to control flow of hydraulic oil to said hydraulic linear actuators.

13. A marine dredging device as described in claim 1 wherein said translatable silt curtains may be operated independent of each other.

14. The method of operating the apparatus of claim 11 whereby:

the device is lowered to the bottom of a body of water with said scoop buckets in the open position and said silt curtains in the retracted position;

the device is thence lowered into the soil;

said silt curtains are thence lowered to make contact with said water bottom;

said helices are activated;

said scoop buckets are thence closed capturing a portion of soil;

said sliding collar is thence retracted thus extruding said soil into said soil receiver and said soil transport tubes;

said silt curtains are thence retracted;

said scoop buckets are thence opened;

said sliding collar is thence lowered thus driving said scoop buckets into said water bottom;

the above sequence of events is repeated in a cyclical fashion.

15. A marine dredging device as described in claim 10 wherein the actuation means is comprised of:

a hydraulic pressure source;

hydraulic linear actuators interconnected between said soil receiver chamber and said scoop buckets so as to impart pivoting motion of said scoop buckets relative to said soil receiver chamber;

hydraulic linear actuators interconnected between said sliding collar and said soil receiver chamber so as to impart translation motion of said sliding collar relative to said soil receiver chamber;

hydraulic motors connected to the axle shafts of said helices so as to impart rotation;

means to control flow of hydraulic oil to said hydraulic linear actuators and hydraulic motors.

16. A marine dredging device as described in claim 10 wherein:

when said scoop buckets are in the fully closed position;

the position, shape and orientation of said non-return valves corresponds with the lowermost inner surfaces of said scoop buckets;

the position, shape and orientation of said soil receiver chamber corresponds with the uppermost inner surfaces of said scoop buckets.

17. A marine dredging device as described in claim 10 with the inclusion of:

cam members affixed to said non-return valves configured to initiate closing of said valves upon contacting said scoop buckets.

18. The method of operating the apparatus of claim 10 whereby:

the device is lowered to the bottom of a body of water with said scoop buckets in the open position and said silt curtains in the retracted position;

the device is thence lowered into the soil;

said helices are activated;

said scoop buckets are thence closed capturing a portion of soil;

said sliding collar is thence retracted thus extruding said soil into said soil receiver and said soil transport tubes;

said scoop buckets are thence opened;

said sliding collar is thence lowered thus driving said scoop buckets into said water bottom;

the above sequence of events is repeated in a cyclical fashion.

19. A marine dredging device as described in claim 10 with the inclusion of:

the device is thence lowered into the soil;

said silt curtains are thence lowered to make contact with said water bottom;

said helices are activated;

said scoop buckets are thence closed capturing a portion of soil;

said sliding collar is thence retracted thus extruding said soil into said soil receiver and said soil transport tubes;

said silt curtains are thence retracted;

said scoop buckets are thence opened;

said sliding collar is thence lowered thus driving said scoop buckets into said water bottom;

the above sequence of events is repeated in a cyclical fashion.

20. A marine dredging device as described in claim 10 with the inclusion of:

one or more non-return valves located at the lower extremity of said soil receiver chamber.

21. A method of dredging marine sediments comprising the following procedures:

cutting and capturing a portion of marine soil;

introducing said soil portion into a receiving chamber through one or more non-return valves;

cutting and capturing subsequent portions of marine soil in a cyclical manner;

introducing said subsequent soil portions into said receiving chamber through said non-return valves thereby extruding soil into soil transport tubing by employing the use of translatable silt curtains adjacent to lateral extremities of scoop buckets serving to block an aperture between said scoop buckets and thence extruding soil from above-water discharge porting.

22. The method of claim 21 with the inclusion of:

deploying mechanical silt curtains prior to closure of said scoop buckets;

retraction of said silt curtains when opening said scoop buckets for subsequent cuts;

repeating deployment and retraction of said silt curtains in a cyclical manner in concert with the soil cut and capture activity.

* * * * *